US011372368B2

(12) United States Patent
Omura

(10) Patent No.: US 11,372,368 B2
(45) Date of Patent: Jun. 28, 2022

(54) IMAGE FORMING APPARATUS THAT PREVENTS CONTAMINATION OF CHARGE NEUTRALIZER PROVIDED IN FIXING DEVICE

(71) Applicant: KYOCERA Document Solutions Inc., Osaka (JP)

(72) Inventor: Hiroyoshi Omura, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/409,706

(22) Filed: Aug. 23, 2021

(65) Prior Publication Data

US 2022/0057747 A1 Feb. 24, 2022

(30) Foreign Application Priority Data

Aug. 24, 2020 (JP) ..... JP2020-140785

(51) Int. Cl.
*G03G 15/20* (2006.01)
*G03G 21/20* (2006.01)

(52) U.S. Cl.
CPC ..... *G03G 21/206* (2013.01); *G03G 15/2028* (2013.01)

(58) Field of Classification Search
CPC ..... G03G 15/2028; G03G 21/206
See application file for complete search history.

(56) References Cited

U.S. PATENT DOCUMENTS

| | | | | |
|---|---|---|---|---|
| 10,564,565 | B1 * | 2/2020 | Kuribayashi | G03G 9/08793 |
| 2008/0159792 | A1 | 7/2008 | Egi | |
| 2018/0032011 | A1 * | 2/2018 | Nanjo | G03G 15/2017 |
| 2018/0173152 | A1 * | 6/2018 | Nakajima | G03G 15/0258 |
| 2018/0217532 | A1 * | 8/2018 | Kikuchi | G03G 15/2025 |
| 2018/0239280 | A1 * | 8/2018 | Takagi | G03G 15/0291 |
| 2019/0129352 | A1 * | 5/2019 | Hattori | G03G 21/0035 |

FOREIGN PATENT DOCUMENTS

| | | |
|---|---|---|
| JP | 2008-164903 A | 7/2008 |
| JP | 2010-102241 A | 5/2010 |

* cited by examiner

*Primary Examiner* — Sevan A Aydin
(74) *Attorney, Agent, or Firm* — IP Business Solutions, LLC

(57) ABSTRACT

An image forming apparatus includes a discharge guide provided downstream of a fixing device in a sheet transport direction, and configured to guide a sheet on which a toner image has been fixed, to a sheet discharge port formed in a main body of the image forming apparatus, the discharge guide including an air vent for cooling the sheet, and a cooling fan that blows air to the sheet passing the discharge guide, through the air vent. A fixing device housing includes an air inlet that allows an airflow generated by the cooling fan toward the sheet and reflected thereby, to be introduced into inside the fixing device housing.

5 Claims, 10 Drawing Sheets

IMAGE FORMING APPARATUS THAT PREVENTS CONTAMINATION OF CHARGE NEUTRALIZER PROVIDED IN FIXING DEVICE

INCORPORATION BY REFERENCE

This application claims priority to Japanese Patent Application No. 2020-140785 filed on Aug. 24, 2020, the entire contents of which are incorporated by reference herein.

BACKGROUND

The present disclosure relates to an image forming apparatus.

Existing image forming apparatuses based on the electrophotography method, in general, are configured to form an electrostatic latent image, by emitting light from an exposure device to the circumferential surface of a uniformly charged photoconductor drum, develop the electrostatic latent image into a toner image with a developing device, and transfer the toner image to a sheet, with a transfer device. The toner image transferred to the sheet is heat-pressed by a fixing device, thus to be fixed onto the sheet.

The fixing device is configured to pass the sheet through between a fixing rotating body such as a fixing roller or fixing belt, and a pressure rotating body such as a pressure roller, thereby fusing the unfixed toner on the sheet, so as to fix the toner onto the sheet.

In such a fixing device, the unfixed toner on the sheet is carrying electric charge, and therefore the electric charge is gradually accumulated on the fixing rotating body, while a plurality of sheets are sequentially passing the fixing device. When the sheet passes the fixing rotating body on which the electric charge is accumulated, the toner image on the sheet may be disordered, which may lead to deterioration in image quality.

As one of the remedies to the above, for example, a fixing device has been proposed in which a charge neutralizing device, for eliminating the electric charge on the surface of the fixing rotating body, is provided inside the housing of the fixing device. The charge neutralizing device includes a conductive charge neutralizer, having a serrated leading edge. The charge neutralizer is mounted such that the leading edge is opposed to the circumferential surface of the fixing rotating body, with a gap therebetween. Although the charge neutralizer is located around the fixing rotating body in this fixing device, another fixing device, in which the charge neutralizer is additionally provided around the pressure rotating body, has also been proposed.

SUMMARY

The disclosure proposes further improvement of the foregoing technique.

In an aspect, the disclosure provides an image forming apparatus including a main body, a fixing device, a discharge guide, a cooling fan, and a charge neutralizer. The main body accommodates therein an image forming device that forms a toner image on a sheet transported along a predetermined transport route. The fixing device is provided downstream of the image forming device in a sheet transport direction, and configured to fix the toner image onto the sheet, by passing the sheet carrying the toner image through between a fixing rotating body and a pressure rotating body, located inside a fixing device housing. The discharge guide is provided downstream of the fixing device in the sheet transport direction, and configured to guide the sheet on which the toner image has been fixed, to a sheet discharge port formed in the main body, the discharge guide including an air vent for cooling the sheet. The cooling fan blows air to the sheet passing the discharge guide, through the air vent. The charge neutralizer is provided inside the fixing device housing, so as to oppose a circumferential surface of a rotating body to be neutralized, constituted of the fixing rotating body or the pressure rotating body, and eliminates electric charge from the circumferential surface of the rotating body to be neutralized. The fixing device housing includes an air inlet that allows an airflow generated by the cooling fan toward the sheet and reflected thereby, to be introduced into inside the fixing device housing.

DETAILED DESCRIPTION

Hereafter, some embodiments of the disclosure will be described in detail, with reference to the drawings. However, the disclosure is not limited to the following embodiments.

Embodiment 1

Figure 1:
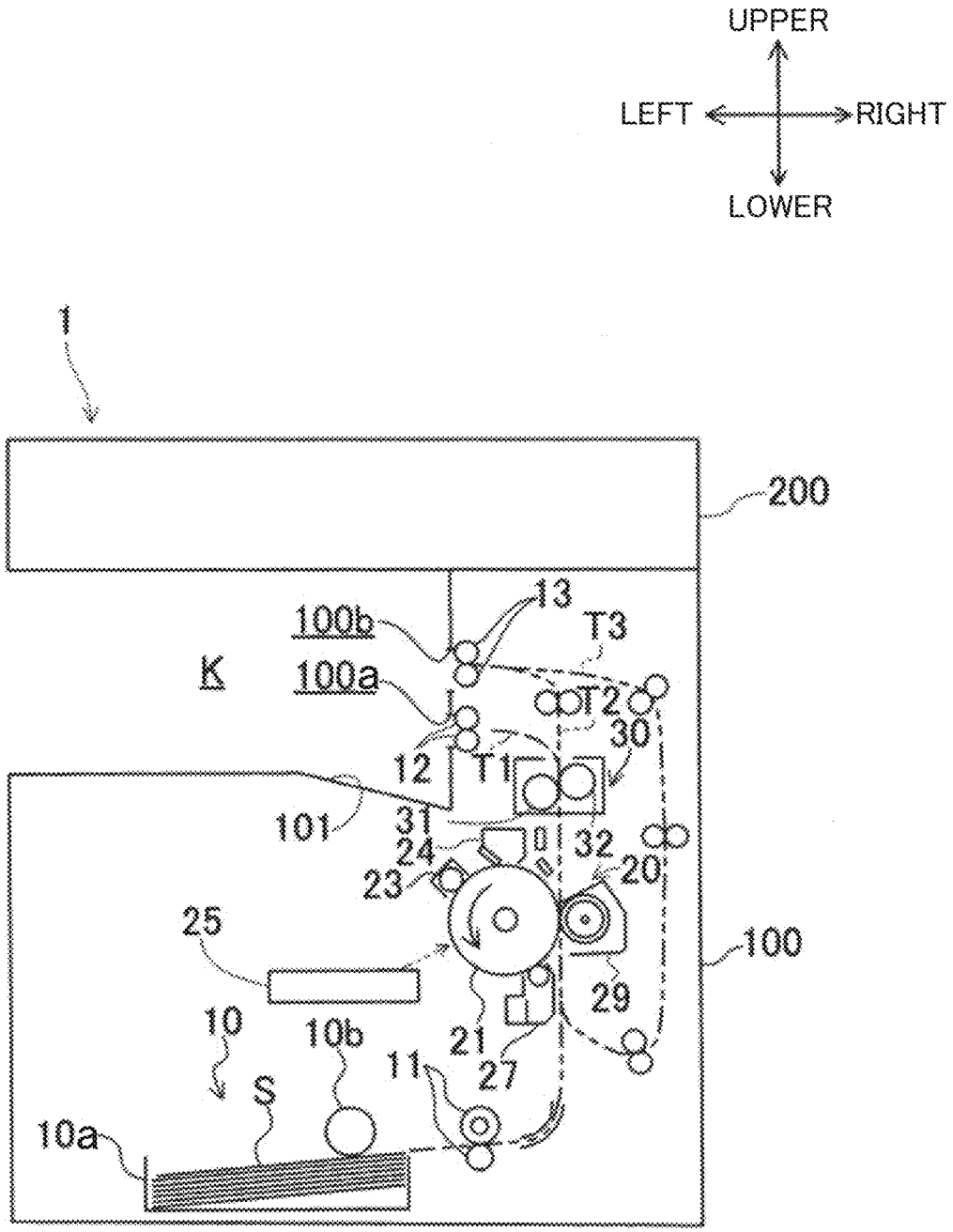
FIG. 1 is a schematic cross-sectional view showing an image forming apparatus according to an embodiment.

FIG. 1 illustrates an example of an image forming apparatus 1 according to Embodiment 1. In the following description, the terms such as "front side", "rear side", "left side", and "right side" each indicate, unless otherwise specifically noted, a direction defined by directional axes in FIG. 1, with respect to the image forming apparatus 1.

The image forming apparatus 1 is what is known as an in-body delivery type copier, and includes a main body 100, and an image reading device 200 located on the upper side of the main body 100.

The image reading device 200 optically reads the image of a source document placed on a contact glass, and transmits the relevant image data to the main body 100. The main body 100 prints the image on a sheet S, on the basis of the image data received from the image reading device 200. A sheet discharge area K for outputting the sheet S is provided between the main body 100 and the image reading device 200, and an output tray 101 is formed in an upper portion of the main body 100 facing the sheet discharge area K.

The main body 100 accommodates therein a paper feeding section 10, an image forming device 20, and a fixing device 30.

The paper feeding section 10 includes a sheet cassette 10*a* and a pickup roller 10*b*. The sheet cassette 10*a* is located at the lower end portion of the main body 100, so as to be drawn out to the front side. In the sheet cassette 10*a*, the sheets S for printing are stacked in a bundle. The pickup roller 10*b* separates, by rotating, the sheets S in the sheet cassette 10*a* one by one, and delivers each of the sheet S to outside of the sheet cassette 10*a*. The sheet S delivered to outside of the sheet cassette 10*a* by the pickup roller 10*b* is supplied to the image forming device 20, through a transport roller pair 11.

The image forming device 20 includes a photoconductor drum 21, a charging device 23, an exposure device 25, a developing device 27, a transfer device 29, and a cleaning device 24. In the image forming device 20, the charging device 23 electrically charges the circumferential surface of the photoconductor drum 21, the exposure device 25 emits a laser beam based on document image data (image data representing the source document image, generated by the image reading device 200) to the surface of the photoconductor drum 21, thereby forming an electrostatic latent image, and the developing device 27 develops the electrostatic latent image formed as above, thereby forming a toner image. The toner image is transferred to the sheet S by a transfer bias applied to the transfer device 29, while the sheet S passes through between the photoconductor drum 21 and the transfer device 29. The toner remaining on the photoconductor drum 21 after the transfer process is removed by the cleaning device 24. The sheet S, to which the toner image has been transferred, is transported to the fixing device 30.

The fixing device 30 includes a fixing roller 31 and a pressure roller 32, configured to rotate pressed against each other. The fixing roller 31 corresponds to the fixing rotating body in the disclosure, and the pressure roller 32 corresponds to the pressure rotating body in the disclosure. The fixing device 30 passes the sheet S delivered from the image forming device 20, through between the fixing roller 31 and the pressure roller 32. As result, the unfixed toner carried by the sheet S is heated and pressed, thus to be fixed onto the sheet S. The sheet S that has passed the fixing device 30 is delivered to a first transport route T1 or a second transport route T2, located on the upper side of the fixing device 30.

The first transport route T1 is utilized in an ordinary simplex printing operation, and includes a discharge roller pair 12 located at an end portion on the downstream side. The sheet S that has passed the first transport route T1 is delivered to the output tray 101 through a first sheet discharge port 100*a*, by the discharge roller pair 12.

The second transport route T2 is utilized in a duplex printing operation, and includes a discharge roller pair 13 located at an end portion on the downstream side. The sheet S that has passed the second transport route T2 is made to expose a part of the leading edge to the sheet discharge area K through a second sheet discharge port 100*b*, by the discharge roller pair 13, and then switched back to be delivered to a third transport route T3. The third transport route T3 forms a looped transport route in collaboration with the first transport route T1, so as to again deliver the sheet S that has been switched back, to the nip between the photoconductor drum 21 and the transfer device 29. Here, the second transport route T2 is also utilized, for example when a relay transport device is mounted on the upper face of the output tray 101, to deliver the sheet S that has undergone the fixing process to the sheet discharge area K, instead of delivering the sheet S to the relay transport device.

Thus, the first transport route T1 includes a first discharge guide 50, and guides the sheet S delivered from the fixing device 30 to the first sheet discharge port 100*a*. The second transport route T2 guides the sheet S, delivered from the fixing device 30 to a route extending along the first transport route T1 and branched therefrom, to the second sheet discharge port 100*b* different from the first sheet discharge port 100*a*.

Configuration of First Discharge Guide

Figure 2:
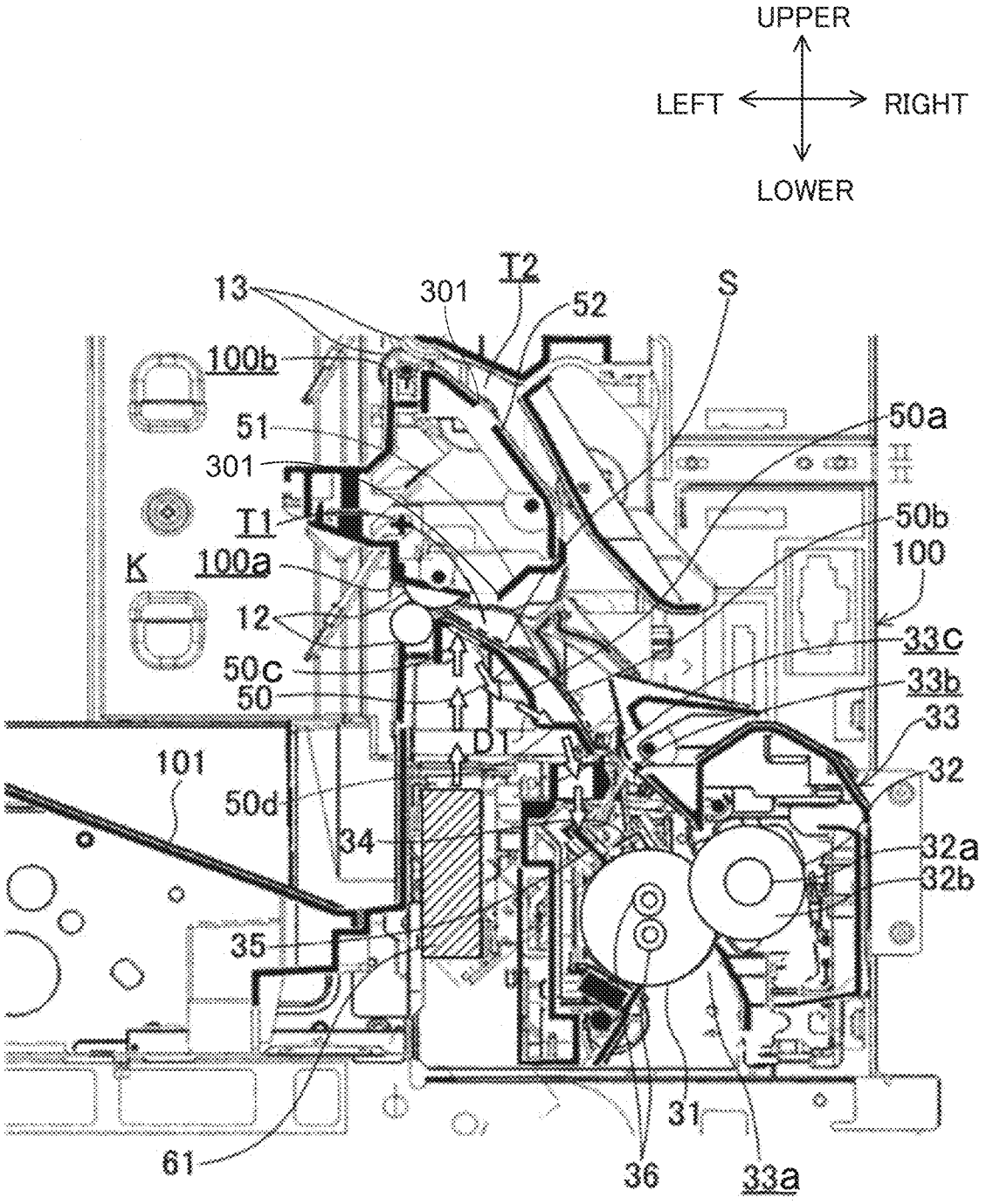
FIG. 2 is an enlarged cross-sectional view showing a fixing device and related parts, in the image forming apparatus.

As shown in FIG. 2, the first discharge guide 50 is located on the lower side of the first transport route T1, so as to extend from a position close to the downstream side of a sheet discharge port 33*b* of the fixing device 30, to a position close to the upstream side of the discharge roller pair 12.

Figure 3:
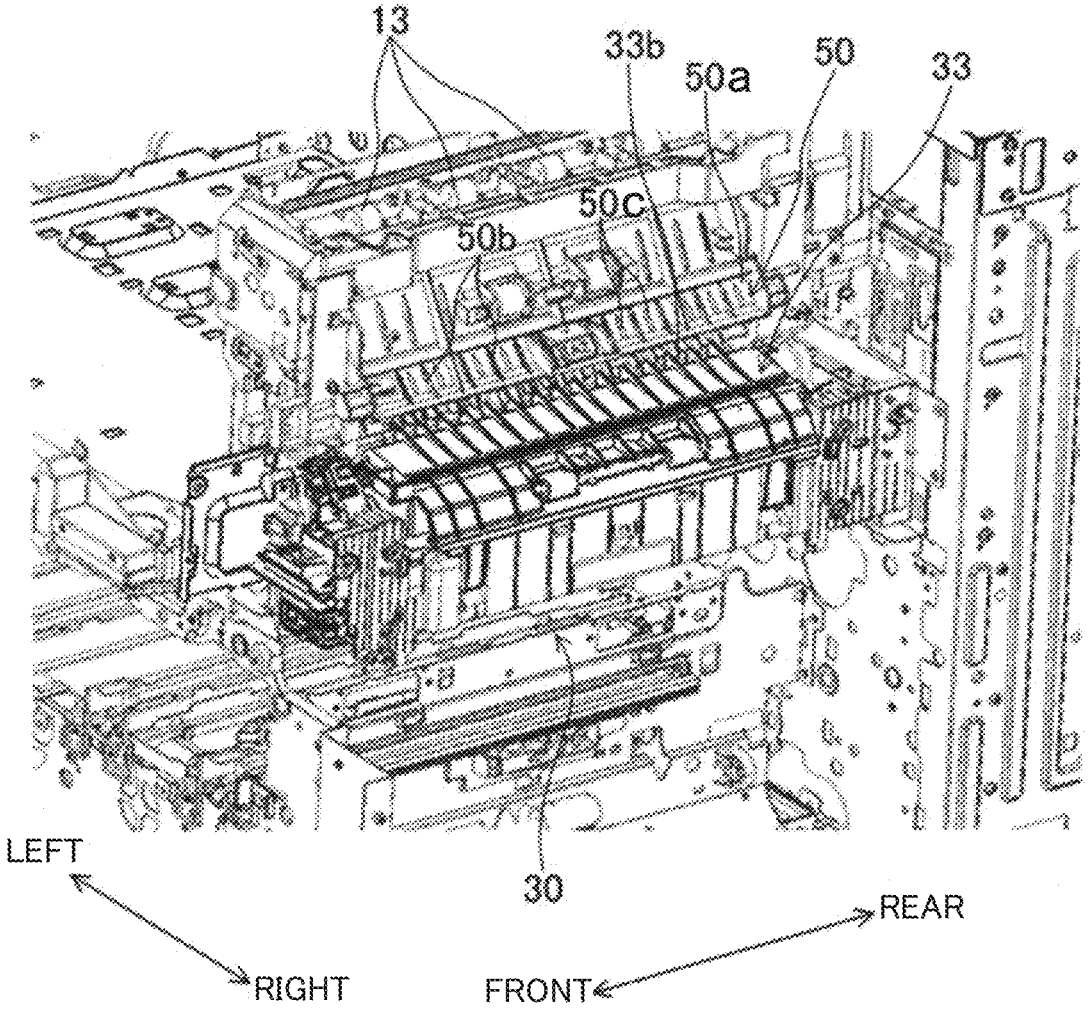
FIG. 3 is a perspective view showing the fixing device mounted in a main body, seen from the right front side.
Figure 4:
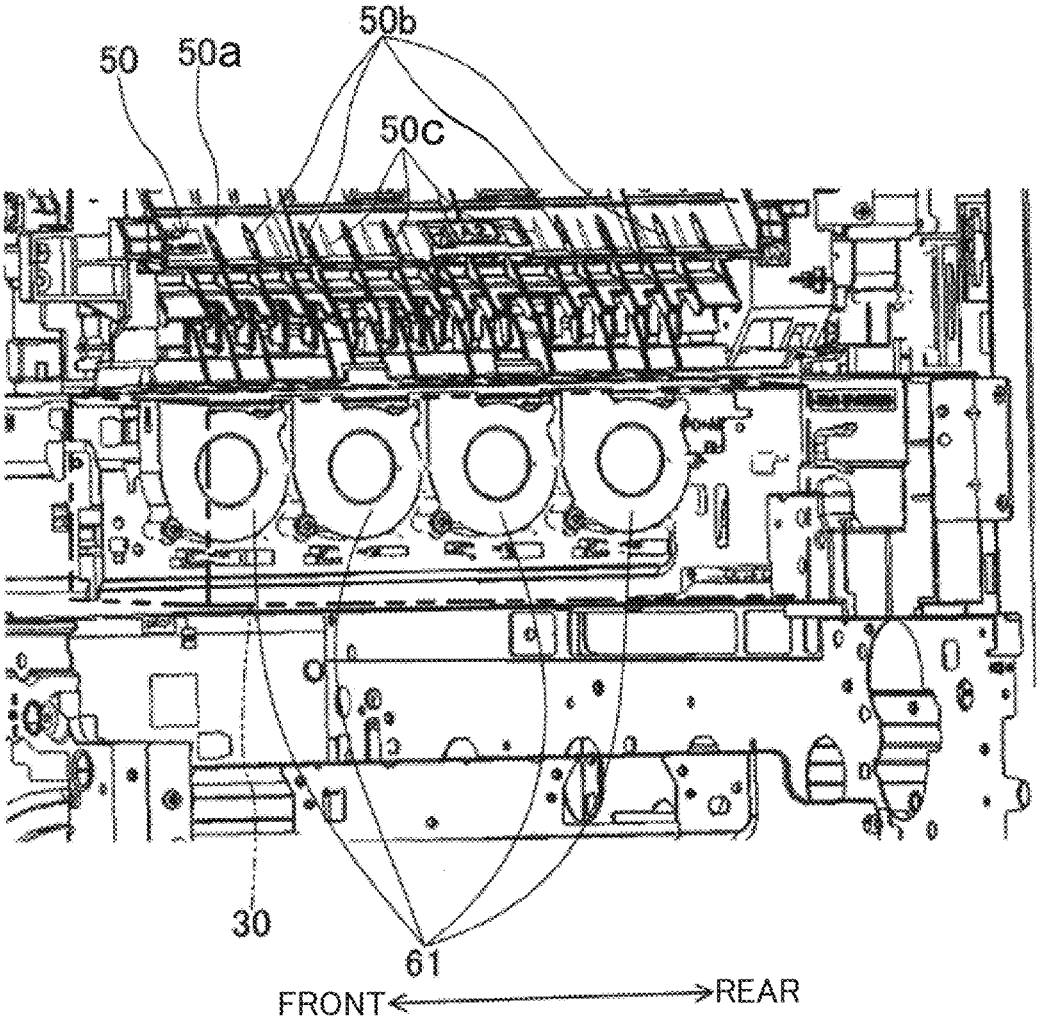
FIG. 4 is a right-side view showing the main body from which the fixing device has been removed.

As shown in FIG. 2 to FIG. 4, the first discharge guide 50 includes a guide base plate 50*a* of a thin plate shape, extending along the first transport route T1, and a plurality of guide ribs 50*b*, each formed on the upper surface of the guide base plate 50*a* so as to protrude therefrom.

The guide base plate 50*a* has, as shown in FIG. 2, the upper end portion bent downward and located adjacent to the right side of the discharge roller pair 12, and the lower end portion located in contact with the right side of air inlets 33*c* (to be subsequently described), formed in the upper face of a fixing device housing 33.

The plurality of guide ribs 50*b* each extend in the sheet transport direction, and slightly protrude from the upper surface of the guide base plate 50*a*. The distal end face of the protruding portion of each of the guide ribs 50*b* serves as the guide surface for guiding the sheet S.

The guide base plate 50*a* includes a plurality of air vents 50*c* for cooling the sheet, each formed between the adjacent ones of the guide ribs 50*b*. The air vents 50*c* are each formed in a slit shape, extending in the sheet transport direction. The air vents 50*c* each have a tapered shape, with a width reducing toward the downstream end in the sheet transport direction, to prevent the sheet S from being caught by the air vent.

Location of Cooling Fan

As shown in FIG. 2, cooling fans 61 that supplies air toward the air vents 50*c* are provided under the first discharge guide 50. In the example according to this embodiment, four cooling fans 61 are provided, each being constituted of a sirocco fan. The cooling fans 61 are aligned in the front-back direction, as shown in FIG. 4. The cooling fans 61 are each mounted with the air outlet oriented upward. The cooling fans 61 are controlled by a non-illustrated control device, for example so as to be activated during execution of a printing job on the sheet S.

The air blown from each of the cooling fans 61 passes the air vents 50*c* of the first discharge guide 50, and then hits the lower face (printing face) of the sheet S passing along the upper face of the first discharge guide 50. Accordingly, the sheet S is cooled by the air from the cooling fans 61. As result, residual heat on the sheet S delivered to the output tray 101 can be reduced and, further, the fixed toner on the sheet S can be prevented from being fused by the residual heat.

In addition, air vents 301 are formed, similarly to the first discharge guide 50, in each of an opposing wall 51 opposed to the upper face of the first discharge guide 50, and a second discharge guide 52 located under the second transport route T2. Therefore, the air supplied from the cooling fans 61 can be blown, not only to the sheet S being transported along the first transport route T1, but also to the sheet S being transported along the second transport route T2.

Thus, the air vents 301, formed in the opposing wall 51 and the second discharge guide 52, each serving as a partition wall separating between the first transport route T1 and the second transport route T2, provide a communication path from the first transport route T1 to the second transport route T2.

Configuration of Fixing Device

Figure 5:
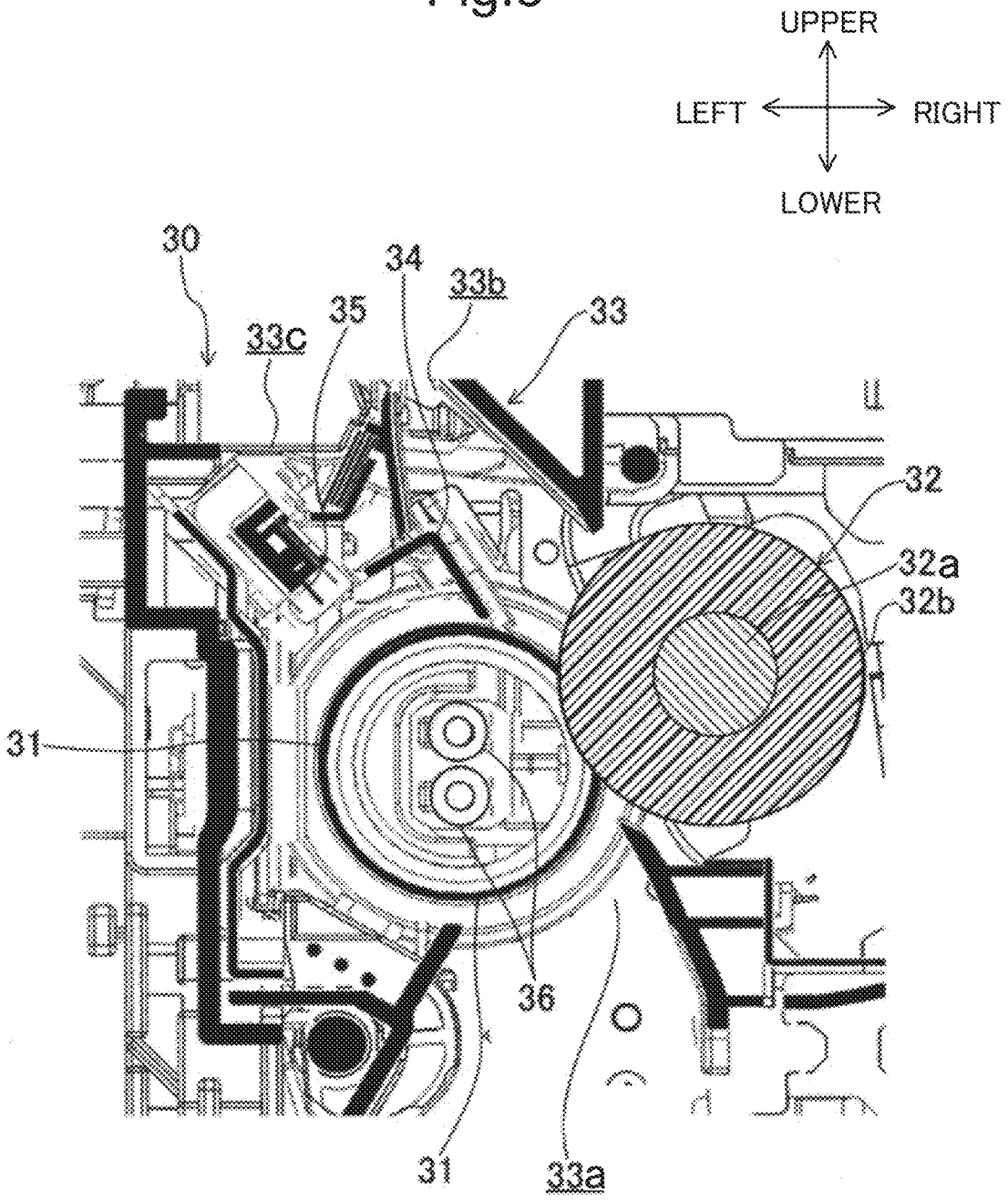
FIG. 5 is an enlarged cross-sectional view showing the fixing device.
Figure 6:
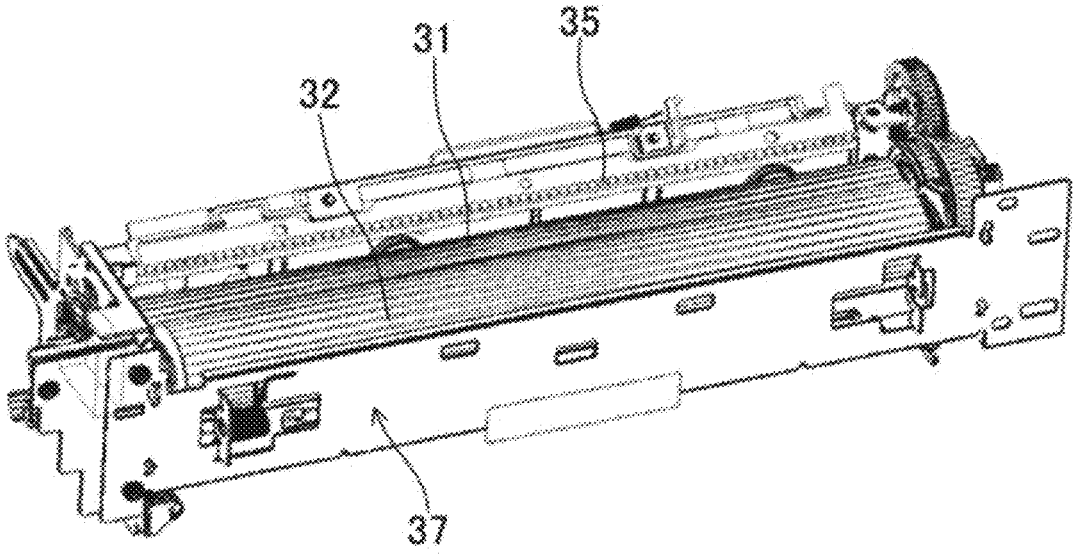
FIG. 6 is a perspective view showing the fixing device from which a fixing device housing has been removed.
Figure 7:
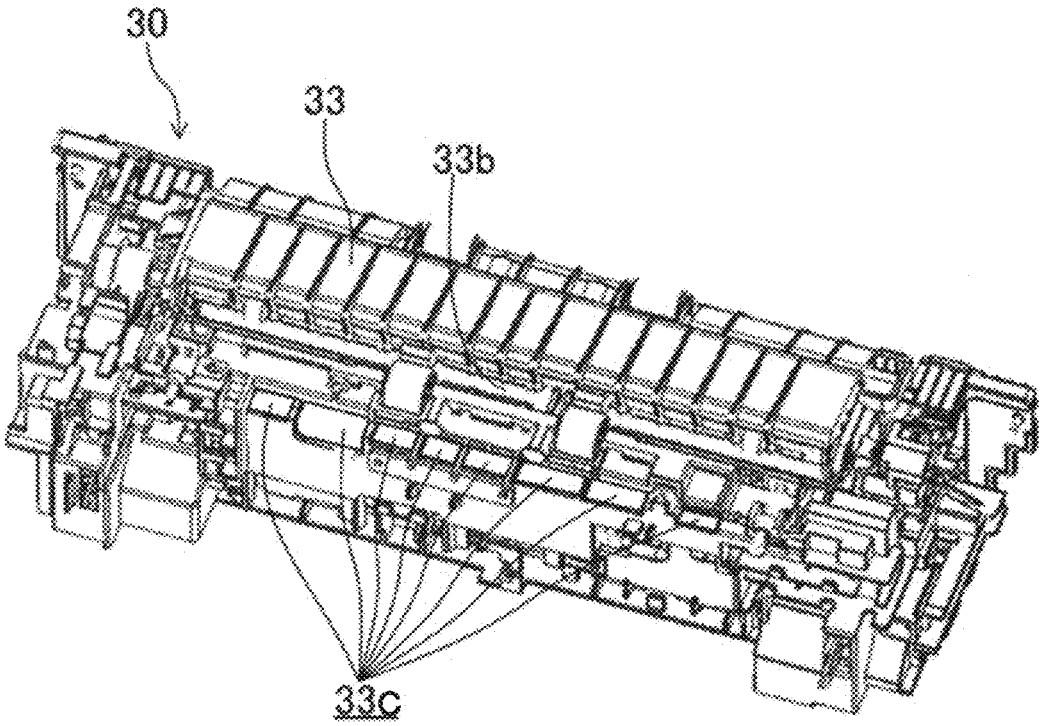
FIG. 7 is a perspective view showing the appearance of the fixing device.

Referring now to FIG. 5 to FIG. 7, the fixing device 30 will be described in further detail. The fixing device 30 includes, the fixing roller 31, the pressure roller 32, and the fixing device housing 33 accommodating these rollers 31 and 32 therein.

The fixing roller 31 includes a core metal, and a release layer formed on the outer circumferential surface of the core metal. The core metal is a thin-wall tube formed of a metal, such as an aluminum alloy or stainless steel. The release layer is formed of a fluororesin such as PFA or PTFE. A cap and a rotation shaft are provided at an end portion of the fixing roller 31 in the longitudinal direction. The rotation shaft is supported, via a bearing, by a sheet metal frame 37 (see FIG. 6) provided inside the fixing device housing 33. Inside the core metal of the fixing roller 31, a pair of halogen heaters 36 are accommodated. The halogen heaters 36 each have a bar shape extending in the front-back direction (axial direction of the fixing roller 31), and serve to heat the fixing roller 31 to a predetermined temperature.

The pressure roller 32 includes a core metal 32*a*, an elastic layer 32*b* provided on the outer circumferential surface of the core metal 32*a*, a non-illustrated release layer provided on the outer circumferential surface of the elastic layer 32*b*, and non-illustrated rotation shafts provided at the respective end portions of the core metal 32*a*. The core metal 32*a* and the rotation shafts are formed of a metal such as stainless steel or an aluminum alloy, in a unified body. The elastic layer 32*b* is, for example, formed of foamed silicone rubber. The release layer is formed of PTFE or PFA. The rotation shafts are supported, via a bearing, by the sheet metal frame 37 (see FIG. 6) provided inside the fixing device housing 33. The pressure roller 32 is driven so as to rotate by a non-illustrated drive source such as a motor, via a gear mechanism. The pressure roller 32 is pressed against the fixing roller 31 by a non-illustrated biasing mechanism, for example including a spring, and defines a nip region through which the sheet S is caught and transported, in collaboration with the fixing roller 31.

The fixing device housing 33 is a box-shaped member formed of a resin, and elongate in the front-back direction (axial direction of the fixing roller 31). The fixing device housing 33 includes, in the lower face thereof, a sheet inlet 33*a* (see FIG. 5) for receiving the sheet S carrying the unfixed toner image. The fixing device housing 33 also includes, in the upper face thereof, a sheet discharge port 33*b*, through which the sheet S that has undergone the fixing process is discharged.

A separation member 34 is provided in the fixing device housing 33, at a position downstream of the fixing roller 31. The separation member 34 is formed of a pillar-shaped member having an L-shaped cross section, and extending along the front-back direction. The separation member 34 is mounted such that an edge portion is opposed to a position on the circumferential surface of the fixing roller 31, downstream of the nip region in the rotating direction, with a gap therebetween.

A charge neutralizer 35, for eliminating electric charge from the surface of the fixing roller 31 (exemplifying the rotating body to be neutralized in the disclosure), is provided in the fixing device housing 33, at a position on the left of the separation member 34. The charge neutralizer 35 is formed of a conductive material, extending in the front-back direction. The charge neutralizer 35 includes an edge portion (on the side of the fixing roller 31) formed in a serrated shape. The edge portion of the charge neutralizer 35 is located with a gap from the circumferential surface of the fixing roller 31. Here, a bias voltage may be applied to the charge neutralizer 35, to further improve the neutralizing efficiency.

As shown in FIG. 2 and FIG. 7, a plurality of air inlets 33*c* for guiding airflow D1 (see FIG. 2), generated by the cooling fan 61 toward the sheet S and reflected thereby, to the fixing device housing 33 are provided, at a position right above the charge neutralizer 35 in the fixing device housing 33. The air inlets 33*c* are formed over a range corresponding to the charge neutralizer 35, in the front-back direction. The air inlets 33*c* are each formed so as to penetrate through the upper wall of the fixing device housing 33, in the up-down direction. The air inlets 33*c* are, as shown in FIG. 2, each opposed to a horizontal wall face 50*d* formed at the lower end portion of the first discharge guide 50. A space (gap) to allow air to pass through is secured between the air inlet 33*c* and the horizontal wall face 50*d*.

In the image forming apparatus 1 configured as above, when the printing operation on the sheet S is started, the cooling fans 61 are activated by the non-illustrated control device. Accordingly, air is blown from the cooling fan 61 toward the air vents 50*c* of the first discharge guide 50, as indicated by white arrows in FIG. 2. The air that has passed through the air vent 50*c* hits the lower face of the sheet S, and is reflected thereby, so as to flow obliquely downward to the right, along the lower face of the first discharge guide 50. After reaching the lower end of the first discharge guide 50, the air flows into the fixing device housing 33, through the air inlets 33*c* formed in the upper face of the fixing device housing 33. Since the charge neutralizer 35 is located right under the air inlets 33*c*, the air that has entered the fixing device housing 33 through the air inlets 33*c* forms an airflow around the charge neutralizer 35. Therefore, the charge neutralizer 35 can be prevented from being contaminated, owing to air residing around the charge neutralizer 35. Moreover, since the air flowing into the fixing device housing 33 through the air inlets 33*c* has a high temperature, because of having cooled the sheet S, the temperature rise of the fixing roller 31 can be kept from being disturbed by this airflow.

When the charge neutralizer is provided inside the fixing device housing, the charge neutralizer may be contaminated, for example, by the toner splashed inside the fixing device housing and stuck to the charge neutralizer, which may lead to degradation in neutralizing efficiency of the charge neutralizer. It may be possible to periodically detach the charge neutralizer and clean the same, but in this case the burden of maintenance work on the user is increased. In contrast, the configuration according to this embodiment prevents the charge neutralizer provided in the fixing device can be prevented from being contaminated.

According to this embodiment, further, the air inlets 33*c* are formed in the wall portion adjacent to the charge neutralizer 35 in the fixing device housing 33. Such a configuration further ensures that the air around the charge neutralizer 35 is prevented from residing.

Embodiment 2

Figure 8:
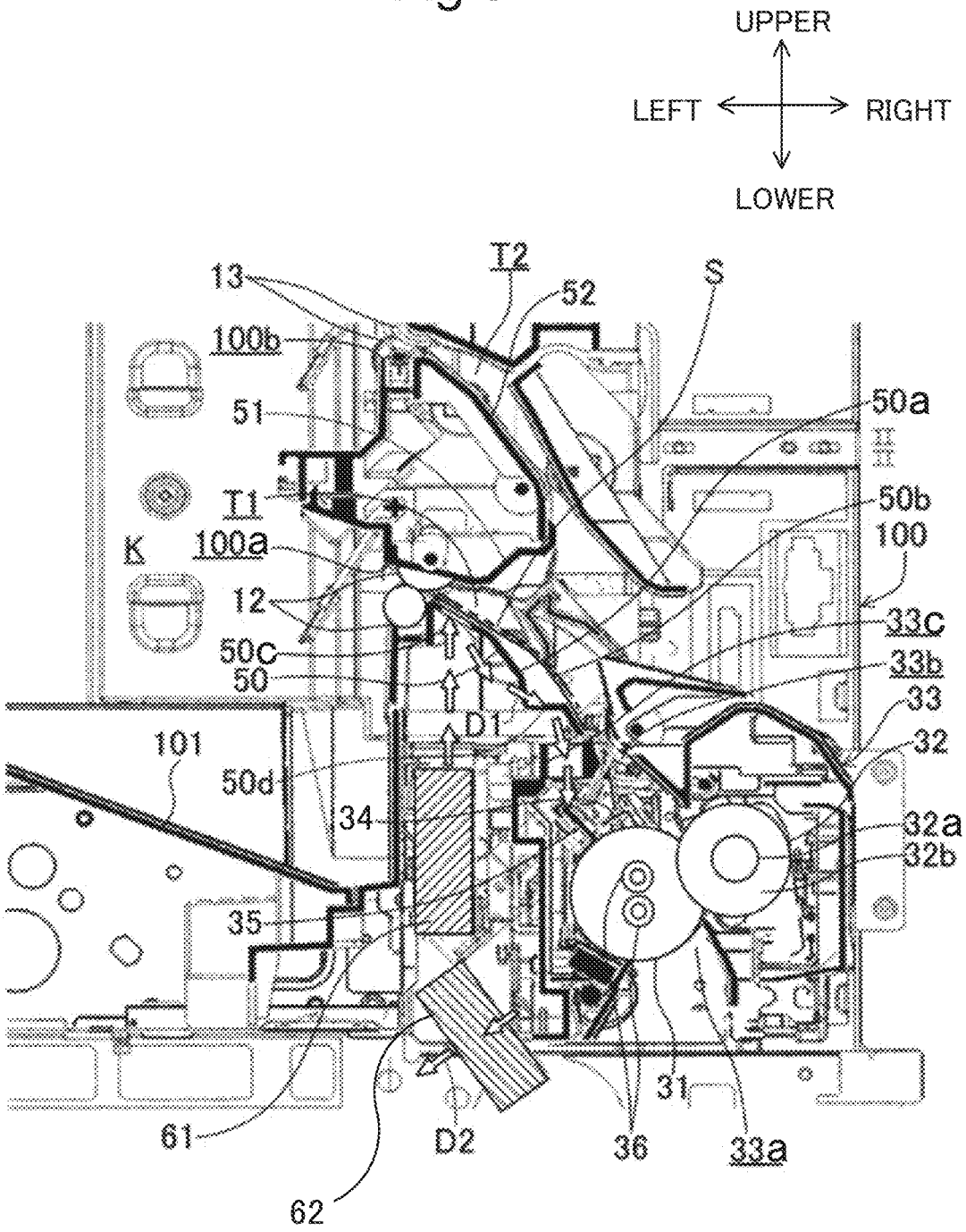
FIG. 8 is an enlarged cross-sectional view corresponding to FIG. 2, showing the fixing device according to Embodiment 2.
Figure 9:
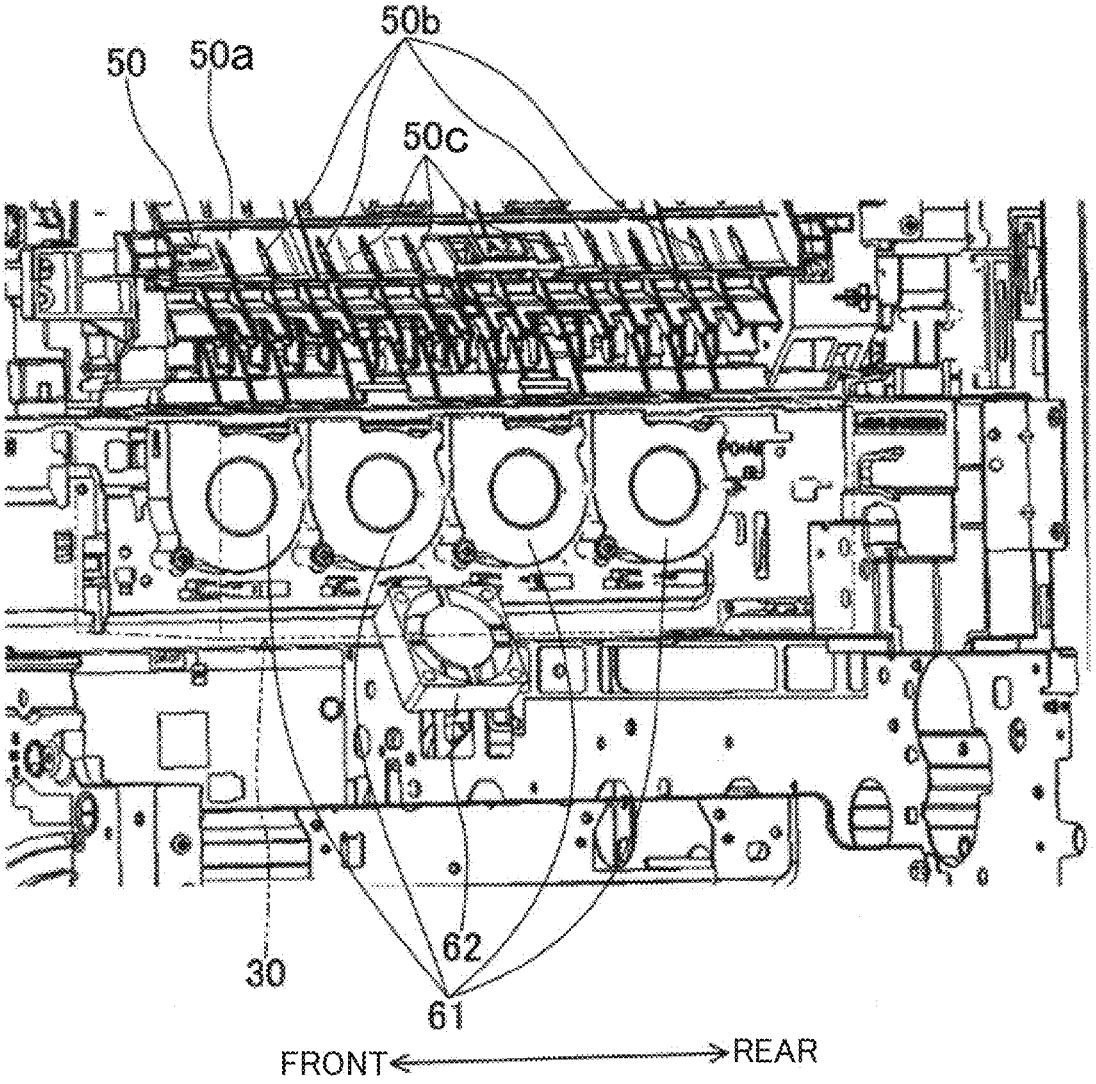
FIG. 9 is a right-side view corresponding to FIG. 4, showing the main body according to Embodiment 2.

FIG. 8 and FIG. 9 illustrate an image forming apparatus according to Embodiment 2. This embodiment is different from Embodiment 1, in further including a fan 62 for air convection (hereinafter, convection fan 62), in addition to the cooling fans 61. In the following description, the same elements as those shown in FIG. 2 and FIG. 4 are given the same numeral, and the description of such elements will not be repeated.

In this embodiment, the convection fan 62 is provided under the cooling fans 61. In the example according to this embodiment, the convection fan 62 is constituted of an axial flow fan. The convection fan 62 is mounted so as to inhale air from inside of the fixing device housing 33, and discharge the air to outside of the fixing device housing 33. The convection fan 62 is located so as to oppose the central portion in the front-back direction, of the left lower corner portion of the fixing device housing 33. The convection fan 62 is mounted such that the axial center is inclined downward to the left, generally at an angle of 45 degrees, when viewed in the front-back direction. When the convection fan 62 is activated, an airflow D2, directed obliquely downward to the left, is generated in the vicinity of the left lower corner portion of the fixing device housing 33. Accordingly, the downward convection of the airflow D1, generated by the cooling fan 61 toward the sheet S and reflected thereby, is further encouraged. As result, the airflow D1 reflected by the sheet S can be surely guided to the air inlet 33*c* of the fixing device housing 33, which enhances the advantageous effect provided by Embodiment 1.

Embodiment 3

Figure 10:
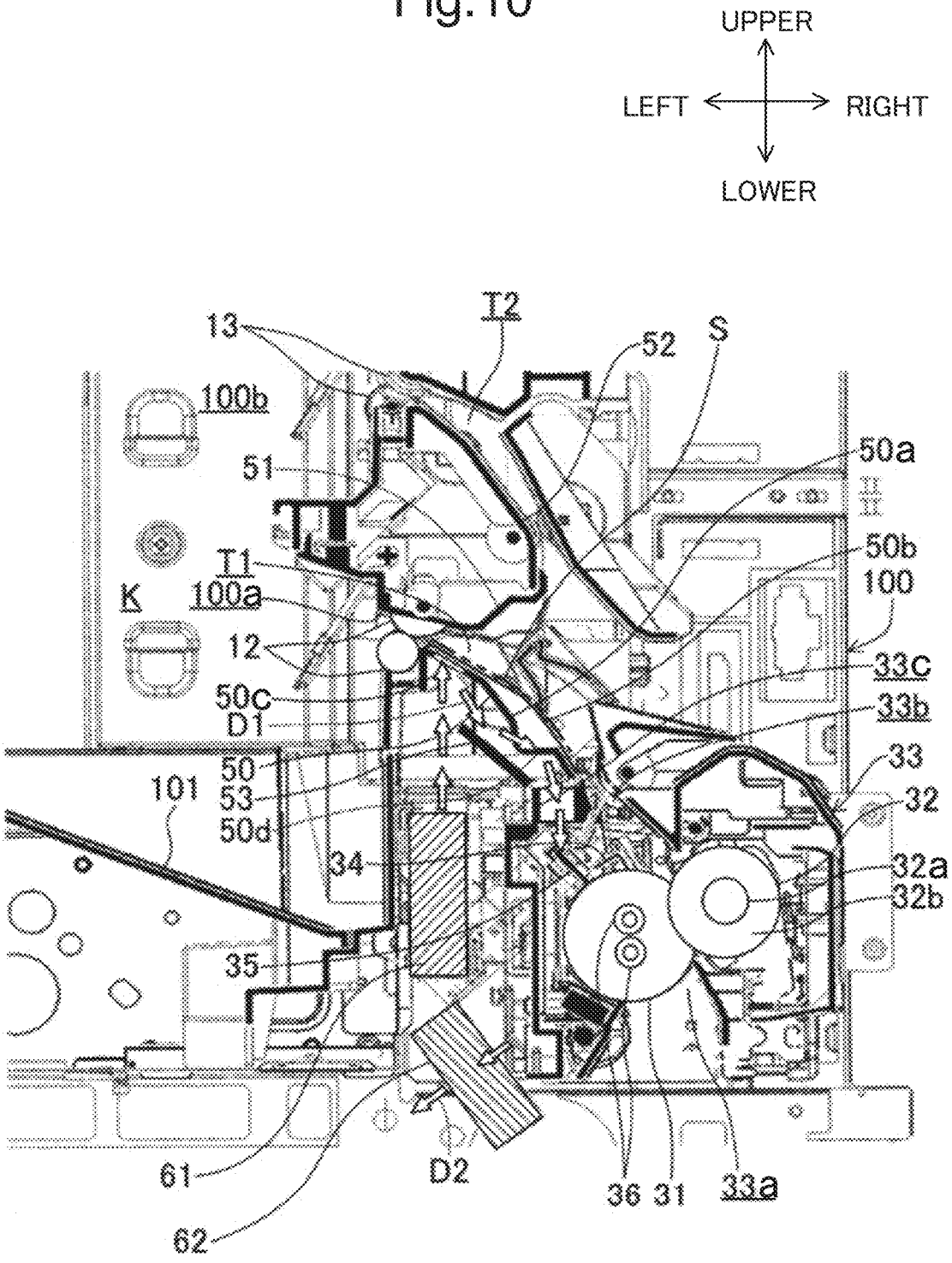
FIG. 10 is an enlarged cross-sectional view corresponding to FIG. 2, showing the fixing device according to Embodiment 3.

FIG. 10 illustrates an image forming apparatus according to Embodiment 3. This embodiment is different from Embodiments 1 and 2, in further including an air discharge guide 53 that guides the airflow D1 reflected by the sheet S, to the air inlet 33*c* of the fixing device housing 33.

The air discharge guide 53 is formed of a flat plate-shaped member, extending in the front-back direction along a left upper portion of the fixing device housing 33. The air discharge guide 53 is inclined downward to the right, and mounted such that the lower edge is located close to the air inlet 33*c* of the fixing device housing 33.

The mentioned configuration further assures that the airflow D1 reflected by the sheet S being transported along the first discharge guide 50 is guided to the air inlet 33*c* of the fixing device housing 33, because of the presence of the air discharge guide 53, which enhances the advantageous effect provided by Embodiments 1 and 2.

Other Embodiment

Although the charge neutralizer 35 is located so as to oppose the circumferential surface of the fixing roller 31, in the foregoing embodiments, the charge neutralizer 35 may be located so as to oppose, for example, the circumferential surface of the pressure roller 32. Such a configuration enables the electric charge, accumulated on the circumferential surface of the pressure roller 32, to be eliminated. In this case, the positional relationship between the fixing roller 31 and the pressure roller 32 may be reversed, to facilitate the airflow D1 reflected by the sheet S to be guided to the periphery of the charge neutralizer 35.

Although the image forming apparatus 1 is exemplified by the copier in the foregoing embodiments, the image forming apparatus 1 is not limited thereto. The image forming apparatus 1 may be configured, for example, as a printer, a facsimile machine, or a multifunction peripheral (MFP).

INDUSTRIAL APPLICABILITY

As described thus far, the disclosure is advantageously applicable to an image forming apparatus, in particular to a printer, a facsimile machine, a copier, and an MFP.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

a main body accommodating therein an image forming device that forms a toner image on a sheet transported along a predetermined transport route;

a fixing device provided downstream of the image forming device in a sheet transport direction, and configured to fix the toner image onto the sheet, by passing the sheet carrying the toner image through between a fixing rotating body and a pressure rotating body, located inside a fixing device housing;

a discharge guide provided downstream of the fixing device in the sheet transport direction, and configured to guide the sheet on which the toner image has been fixed, to a sheet discharge port formed in the main body, the discharge guide including an air vent for cooling the sheet;

a cooling fan that blows air to the sheet passing the discharge guide, through the air vent; and a charge neutralizer provided inside the fixing device housing, so as to oppose a circumferential surface of a rotating body to be neutralized, constituted of the fixing rotating body or the pressure rotating body, and configured to eliminate electric charge from the circumferential surface of the rotating body to be neutralized, wherein the fixing device housing includes an air inlet that allows an airflow generated by the cooling fan toward the sheet and reflected thereby, to be introduced into inside the fixing device housing.

2. The image forming apparatus according to claim 1, wherein the air inlet is formed in a wall portion of the fixing device housing, located adjacent to the charge neutralizer.

3. The image forming apparatus according to claim 1, further comprising a convection fan that forcibly convects the air reflected by the sheet, toward the air inlet of the fixing device housing.

4. The image forming apparatus according to claim 1, further comprising an air discharge guide that guides the air reflected by the sheet toward the air inlet of the fixing device housing.

5. The image forming apparatus according to claim 1, further comprising:

a first transport route including the discharge guide, and configured to guide the sheet delivered from the fixing device to the sheet discharge port; and a second transport route that guides the sheet, delivered from the fixing device to a route alongside the first transport route and branched therefrom, to a second sheet discharge port different from the sheet discharge port, wherein a partition member separating between the first transport route and the second transport route includes an air vent that provides a communication path from the first transport route to the second transport route.

* * * * *